US010771901B2

(12) United States Patent
Skellett et al.

(10) Patent No.: US 10,771,901 B2
(45) Date of Patent: Sep. 8, 2020

(54) LOUDSPEAKER DRIVER SURROUND

(71) Applicant: GP Acoustics (UK) Limited, Maidstone, Kent (GB)

(72) Inventors: Allan James Skellett, London (GB); Jack Anthony Oclee-Brown, Staplehurst (GB)

(73) Assignee: GP Acoustics (UK) Limited, Maidstone (GB)

( * ) Notice: Subject to any disclaimer, the term of this patent is extended or adjusted under 35 U.S.C. 154(b) by 0 days.

(21) Appl. No.: 15/902,634

(22) Filed: Feb. 22, 2018

(65) Prior Publication Data

US 2018/0242086 A1 Aug. 23, 2018

(30) Foreign Application Priority Data

Feb. 22, 2017 (GB) ..... 1702849.9

(51) Int. Cl.
*H04R 7/18* (2006.01)
*H04R 9/06* (2006.01)
(Continued)

(52) U.S. Cl.
CPC ..... *H04R 9/06* (2013.01); *H04R 7/18* (2013.01); *H04R 7/20* (2013.01); *H04R 9/025* (2013.01); *H04R 2307/207* (2013.01)

(58) Field of Classification Search
CPC ..... H04R 7/16; H04R 7/18; H04R 2307/207
See application file for complete search history.

(56) References Cited

U.S. PATENT DOCUMENTS 1,829,355 A * 10/1931 Houghton ..... H04R 7/20 181/173
2,442,791 A 6/1948 Wente
(Continued)

FOREIGN PATENT DOCUMENTS

EP 1659823 A2 5/2006
GB 368926 A 3/1932
(Continued)

OTHER PUBLICATIONS

Search Report issued for GB1702849.9 dated Apr. 19, 2017.

*Primary Examiner* — Fan S Tsang
*Assistant Examiner* — Ryan Robinson
(74) *Attorney, Agent, or Firm* — Westman, Champlin & Koehler, P.A.; Z. Peter Sawicki; Amanda M. Prose

(57) ABSTRACT

A loudspeaker driver surround 2 comprises a flexible, generally annular element having a central axis 8 along which in use a diaphragm is driven, an outer edge 6 for fitment to an enclosure and an inner edge 4 for fitment to the diaphragm, with a roll surface which extends between the edges and which projects in the direction of the axis, wherein the roll surface has a shape formed by a plurality of axial corrugations 10 extending generally radially with respect to the annular element between the outer and inner edges thereof, the corrugations being shaped and configured such that the roll surface is non-axisymmetric about the axis, and the arrangement being such that cross-sections of the roll surface which extend radially with respect to the annular element between the outer and inner edges thereof have a substantially constant length at all circumferential positions around the annular element and so that the shape of the said cross-section varies continuously between circumferential positions around the annular element, the corrugations giv-
(Continued)

ing the projecting roll surface an order of rotational symmetry of at least 30.

16 Claims, 9 Drawing Sheets

(51) Int. Cl.
*H04R 9/02* (2006.01)
*H04R 7/20* (2006.01)

(56) References Cited

U.S. PATENT DOCUMENTS

| | | | | |
|---|---|---|---|---|
| 3,563,337 | A * | 2/1971 | Kawamura | H04R 7/20 181/166 |
| 6,697,496 | B2 * | 2/2004 | Frasl | H04R 7/20 181/171 |
| 7,054,459 | B2 * | 5/2006 | Kuze | H04R 7/20 181/172 |
| 7,397,927 | B2 * | 7/2008 | Pircaro | H04R 7/20 181/172 |
| 8,139,812 | B2 * | 3/2012 | Basnet | H04R 7/20 181/171 |
| 8,340,340 | B2 * | 12/2012 | Bogdanov | H04R 7/20 381/396 |
| 9,253,576 | B2 * | 2/2016 | Tripp | H04R 9/04 |
| 9,271,082 | B2 * | 2/2016 | Oclee-Brown | H04R 7/20 |
| 9,961,448 | B2 * | 5/2018 | Huang | H04R 7/16 |
| 2003/0070869 | A1 * | 4/2003 | Hlibowicki | H04R 7/18 181/172 |
| 2008/0212822 | A1 | 9/2008 | Basnet | |
| 2011/0164782 | A1 | 7/2011 | Bogdanov et al. | |
| 2017/0289689 | A1 * | 10/2017 | Guo | H04R 1/10 |

FOREIGN PATENT DOCUMENTS

| | | | |
|---|---|---|---|
| GB | 1247434 | A | 9/1971 |
| GB | 2035008 | A | 6/1980 |
| GB | 2471924 | A | 1/2011 |
| JP | S58127499 | A1 | 7/1983 |
| WO | 1998/007294 | A1 | 2/1998 |

* cited by examiner

| | Parabolic | Sawtooth |
|---|---|---|
| |   |   |
| Length | 31.42 | 31.42 |
| Difference area | 37.59 | 83.76 |
| Effective thickness | 1.196 | 2.666 |
| Effective thickness ratio for 0.7mm | 1.709 | 3.809 |

LOUDSPEAKER DRIVER SURROUND

FIELD OF THE INVENTION

The present invention relates to loudspeaker driver surrounds.

BACKGROUND ART

A common type of loudspeaker transducer (or driver) has an electromagnetic coil suspended in a strong magnetic field, normally a coil of wire suspended in a gap between the poles of a permanent magnet. When an alternating current electrical audio signal is applied to the voice coil, the coil is forced to move rapidly back and forth due to Faraday's law of induction, which causes a diaphragm or cone attached to the coil to move back and forth, pushing on the air to create sound waves. The electromagnet and the diaphragm vibrate in a direction usually referred to as the driver axis, or the loudspeaker axis. The electromagnet (or voice coil) is housed in a voice coil assembly so that it is free to move reciprocally a pre-determined displacement along the driver axis. Commonly, the voice coil and the diaphragm are circular (in the plane transverse to the driver axis) and there is at least one driver surround (or suspension) which is also circular/annular and disposed generally in the same transverse plane; the driver surround is usually formed of a resiliently flexible material, such as plastic, rubber or felt, and it functions (sometimes together with a spider) to support the electromagnet and the voice coil in position, centering them both on and along the axis, to ensure that the vibrating driver is constrained to move only along the driver axis, and to urge the driver towards a pre-determined point along that axis (the 'restoring force'). In many cases the surround protrudes along the driver axis in the direction in which the diaphragm propagates sound in a curved "roll"; in other cases the surround protrudes in the opposite direction, in a "reverse roll". The shape of these rolls is important in determining the audio and mechanical characteristics of the surround; in this application the term 'roll surface' is used to define the shape of this surface, in particular it is the shape of a radial cross-section of the surround (i.e. taken in the plane of the driver axis) between the edge of the surround which is fixed to the enclosure and the edge which is fixed to the diaphragm (and/or driver).

As is known, suspension stiffness plays a significant part in determining the resonant frequency of the loudspeaker. The softer the suspension, the lower the resonant frequency, and the more efficiently the loudspeaker can reproduce low frequencies, so the loudspeaker designer chooses a surround material of appropriate stiffness to complement the shape of the surround to optimise performance. The loudspeaker transducer is normally housed in a speaker enclosure or cabinet, with the driver surround also serving to seal the gap between the outer circumference of the voice coil and the enclosure; this is important because it significantly affects the quality of the sound the loudspeaker generates. The materials and shape and size of the enclosure are also important factors affecting the quality of the sound generated.

A vibrating driver diaphragm creates sound in the axial direction away from the loudspeaker, and it also creates sound waves within the enclosure; these internal sound waves have to be catered for also in the design of the loudspeaker to ensure high fidelity, and a common design intended to address this is the well-known port reflex speaker. Another characteristic of such vibrating driver diaphragm loudspeakers is that the movement of the vibrating driver diaphragm out of and into the enclosure changes the volume of the enclosure. As the diaphragm reciprocates it moves into and out of the enclosure, and, where the enclosure is relatively small in relation to the volume swept by the diaphragm (for example an enclosure volume of 4 litres and a diaphragm diameter of 120 mm, giving a volume change of about 2%), this change in volume has significant effects: it gives rise to a change in the back pressure within the enclosure and, where this back pressure acts on the flexible surround it causes the surround to deform. This is shown in the cross-sectional drawings of FIGS. 1A-1C. FIG. 1A shows a surround 1 having a reverse roll 3 which is connected to a diaphragm 5; in this drawing the surround 1 is shown at rest, in FIGS. 1B and 1C the diaphragm 5 has been displaced backwardly (i.e. to the left in the drawing). In FIG. 1B the surround is displaced in free air (i.e. there is no enclosure), whereas in FIG. 1C the surround 1 is fixed to a relatively small (41) enclosure (not shown). The outer edge of the surround 1 (the thickest, uppermost part in the drawings) is fixed (in FIG. 1C it would be fixed to the enclosure). It can be seen that with back pressure in FIG. 1C the outer wall of the surround 1 is pushed significantly inwards such that the edge of the diaphragm 5 collides with it much earlier than is the case in free air (as in FIG. 1C). The deformation of the surround due to the back pressure, and the collision of the diaphragm with the surround adversely affect the sound quality produced by the loudspeaker.

One approach to try and address the deformation caused by back pressure is to increase the thickness of the surround, on the basis that a thicker surround is better able to resist the back pressure, as in WO 1998/007294. However, this increases the mass of the surround, producing a surround having a very nonlinear restoring force, and also gives the driver a very poor frequency response, lowering bass output, breakup frequency and sensitivity. This is illustrated in FIG. 2, which shows the frequency response of two surrounds which are of similar design, but the first surround, with frequency response shown as curve 7, has a thin surround (0.7 mm) and the second surround, with frequency response shown as curve 9, has a thicker surround (1.5 mm). The surrounds producing the frequency curves illustrated have the following characteristics:

| | Thin surround 7 (0.7 mm) | Thick surround 9 (1.5 mm) |
|---|---|---|
| Resting stiffness | 2400 N/m | 14400 N/m |
| Breakup frequency | 1250 Hz | 780 Hz |
| Sensitivity | 87 dB | 85 dB |
| Moving mass | 18.5 | 20.5 g |
| Buckling | 13 mm | >20 mm |

There is a further deformation problem which arises with traditional surrounds, which is their tendency to 'buckle' when they deform. Such buckling is a result of the geometry of the surrounds ("geometric buckling") and occurs whether or not the surround is subject to back pressure. In the simple example of a surround having a cylindrical roll surface, in order for the diaphragm to move through a significant axial distance the roll surface must change in shape from a semicircle to a more linear shape; for this to take place, parts of the surround must compress and/or stretch; the surround material is generally not capable of accommodating all the deformation and therefore the surround tends to fold and buckle. Such buckling causes undesirable noise by displacing air and also due to the restoring force changing suddenly when buckling occurs. The pressure deformation of a traditional surround can also lead to geometric buckling occurring much earlier than in free air, as the outer wall of the surround is rapidly forced to a smaller diameter. The buckling causes the restoring force of the surround to change suddenly, increasing distortion. FIG. 3 illustrates the change in restoring force for two similar surrounds, the first shown as curve 11 is of the surround moving in free air (as in FIG. 1B) and the second shown as curve 13 moving when fixed to a relatively small (41) enclosure; it can be clearly seen that the surround has a much more linear restoring force range in the free air example.

There is a need for a surround which can be utilised with a small enclosure but which is resistant to geometric buckling and to uncontrolled deformation caused by back pressure as the diaphragm vibrates, but which is also light.

SUMMARY OF THE INVENTION

The present invention is predicated on a realisation that providing the surround with a means to deform in a controlled manner can avoid previously uncontrolled geometric buckling whilst deforming ("unfolding") in a controlled manner and resisting back pressure, and that an appropriately shaped and configured surround can also help minimise the mass of the surround.

The present invention therefore provides a loudspeaker driver surround comprising a generally annular element of flexible and suitably resilient material and having a central axis along which in use a diaphragm is driven, a first circumferential edge for fitment to an enclosure and a second circumferential edge for fitment to a diaphragm and/or a voice coil, with a roll surface extending between the edges which projects in the direction of the axis, the roll surface being provided with a plurality of smoothly rounded corrugations or folds extending generally radially with respect to the annular element between the outer and inner edges thereof, the corrugations being shaped and configured such that the roll surface is non-axisymmetric about the axis, and the arrangement being such that cross-sections of the roll surface which extend radially with respect to the annular element between the first and second edges thereof have a substantially constant length at all circumferential positions around the annular element and so that the shape of the said cross-section varies continuously between successive circumferential positions around the annular element, the corrugations giving the projecting roll surface an order of rotational symmetry of at least 30.

The term "corrugations" is used herein to denote a rounded surface having a series of ridges and furrows which are smoothly contoured, with no sharp-edged grooves, folds, pleats or sharp discontinuities in surface shape; such smooth corrugations are able to unfold predictably, like sharply pleated corrugations, but they unfold over a more extensive area and are more resistant to back pressure. Another advantage is that at high excursions the sharp edges of a pleated surround will open more readily as the angle of the fold increases, resulting in a reduction of the restoring force. In contrast, with smooth corrugations this reduction in the restoring force would not happen, as the unfolding takes place over the whole surface of a smooth corrugation (rather than just at the sharp edges of a pleated surround).

We have found that driver surrounds with a smoothly corrugated roll surface which is non-axisymmetric but which has a high order of rotational symmetry (of at least 30, 40 or 50, but up to any number such as 100 or 200, provided suitably accurate tooling can be produced to manufacture the surrounds) can avoid buckling under back pressure yet deform controllably in the region of the corrugations when the diaphragm is driven without adversely affecting audio performance. Having corrugations on essentially all parts of the roll surface (i.e. all the parts of the surround which move in use) avoids axisymmetry. "Axisymmetry" means symmetric about the axis at any angle around that axis; an object has rotational symmetry if there is a centre point around which the object is turned (rotated) a certain number of degrees and the object looks the same. The number of positions in which the object looks exactly the same is called the order of symmetry; the order of symmetry is the same as the number of corrugations. Additionally, such an arrangement allows the roll surface to be of substantially constant thickness, which minimises the mass of the surround in the sense that the corrugations add no material which does not contribute to the ability of the surround to flex and the diaphragm to reciprocate along the drive axis (corrugated surrounds per se are not new, see for example U.S. Pat. No. 8,340,340 which has corrugations which "bulge" at the top of the surround, but which do not add to the surround's ability to extend axially). Suitably, the first circumferential edge is the outer edge and the second edge is the inner edge.

When the annular element is viewed axially, points on some of the corrugations, which points are most axially distant from the circumferential edges, form generally linear creases at a first angle to the radial direction between the first and second circumferential edges (this means that the first angle is not at 0° and not at 90° to the radius). Accordingly each corrugation is neither wholly radial nor wholly non-radial; and, when we refer to the surround being viewed it is intended that the resiliently flexible surround is viewed in its relaxed state. When the annular element is viewed axially, points on others of the corrugations, which points are most axially distant from the circumferential edges, form generally linear creases at a second angle to the radial direction between the circumferential edges (this also means that the second angle is neither 0° nor 90°). The first and second angles are preferably equal and opposite, and the linear creases may be joined at their ends. This provides a "zigzag" shaped corrugation when seen axially, and the equal angles allows the zigzag pattern to be symmetrical about the circular centre line; such symmetry is advantageous because it means that the corrugations can deform without imparting any twisting motion to the inner edge, so that the diaphragm reciprocates axially only, with no tangential movement.

In radial cross section the roll surface preferably comprises a succession of curves alternating to the left and right hand side of a centre line, said curves blending into a uniform roll surface between each curve. The left and right hand side curves may be mirror images, similar but reversed, and are preferably aligned relative to the uniform roll section that there is no single common point of intersection of the three profiles; they may have a saw tooth profile, having steep and gentle slopes in alternating directions. Such an arrangement allows the roll surface to have a large effective thickness, whilst avoiding the geometric buckling which would be encouraged were there a common intersection point between all three profiles. The exact shape can be determined empirically, and is dependent on the process used to manufacture the surround.

Preferably the shape and configuration of the corrugations on the roll surface are such that if one circumferential edge of the annular element were extended axially away from the other circumferential edge to the maximum extent, the roll surface would adopt a substantially smooth frusto-conical shape. This is a design constraint which helps minimise the amount of material in the surround whilst still allowing it to deform controllably and without adverse effects on the sound quality. Another feature which affects the weight of the surround is its thickness; the present design is such that the thickness is able to be substantially constant, and this is preferred.

There may be sidewalls extending substantially axially adjacent one or both circumferential edges, and the corrugations may extend along these and blend smoothly to disappear at the circular junctures between the sidewalls and the outer and inner edges. Preferably the corrugations blend into each other smoothly and with no sudden discontinuities.

The invention also encompasses a loudspeaker having a driver surround as defined above.

BRIEF DESCRIPTION OF THE DRAWINGS

The invention will now be described by way of example and with reference to the accompanying figures, in which.

DETAILED DESCRIPTION OF THE EMBODIMENTS

Figure 1C:
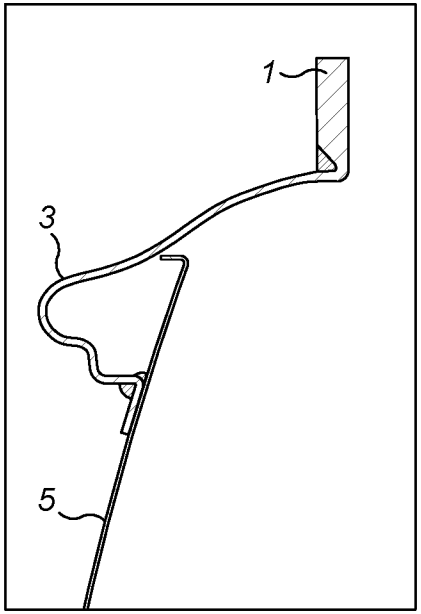
FIG. 1C Prior Art
FIGS. 1A-1C are schematic views of a prior art surround connected to a diaphragm in various stages of displacement.
Figure 1B:
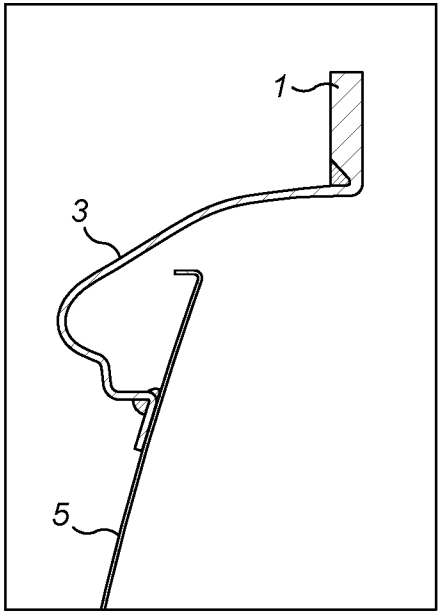
FIG. 1B Prior Art
Figure 1A:
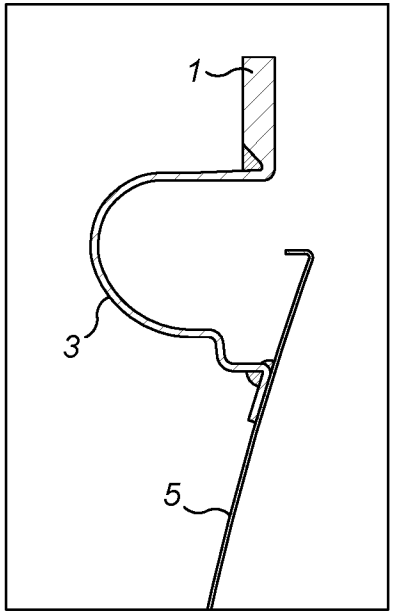
FIG. 1A Prior Art
Figure 2:
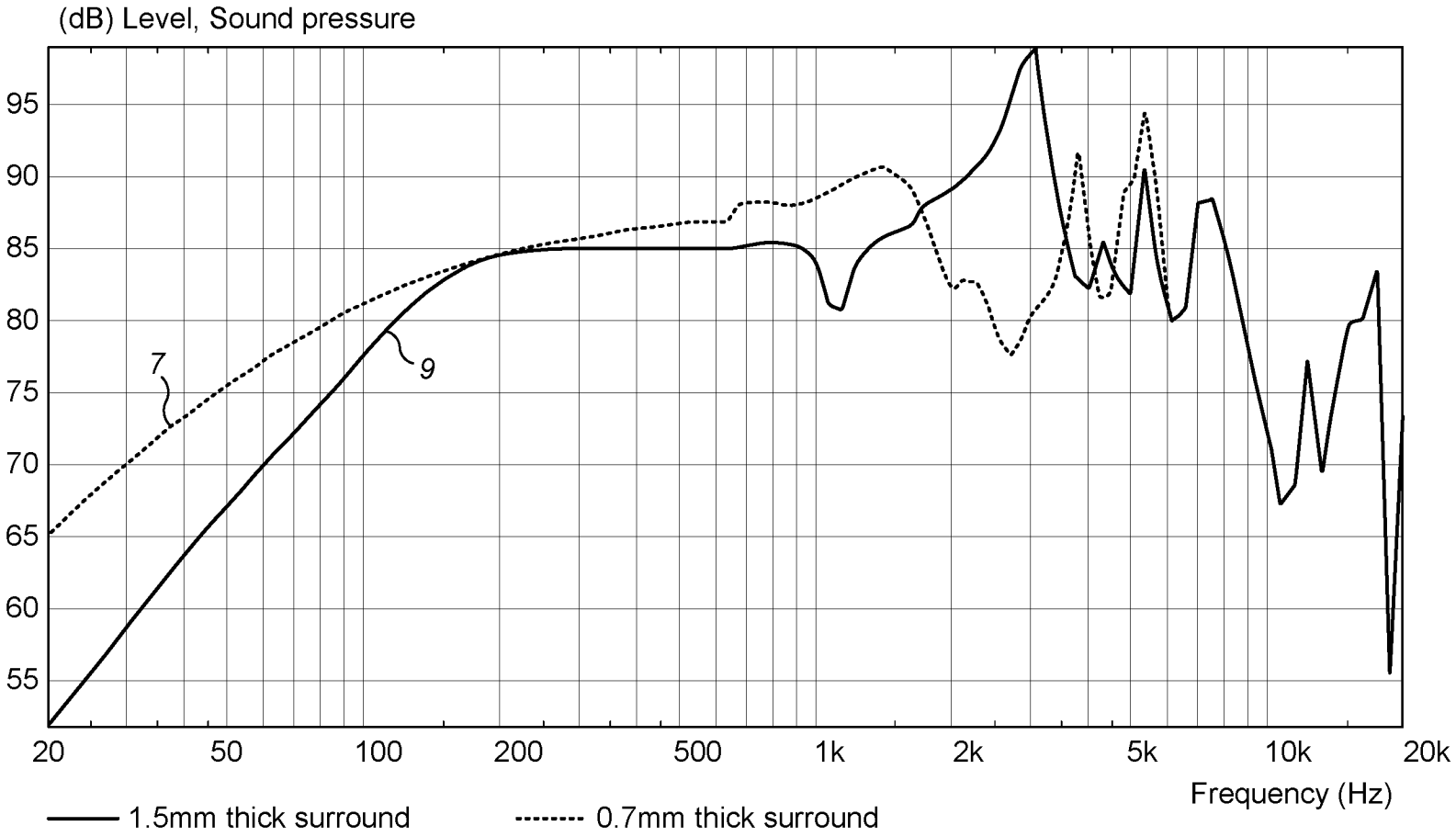
FIG. 2 shows the frequency response of two prior art surrounds which are of similar design but of different thicknesses.
Figure 3:
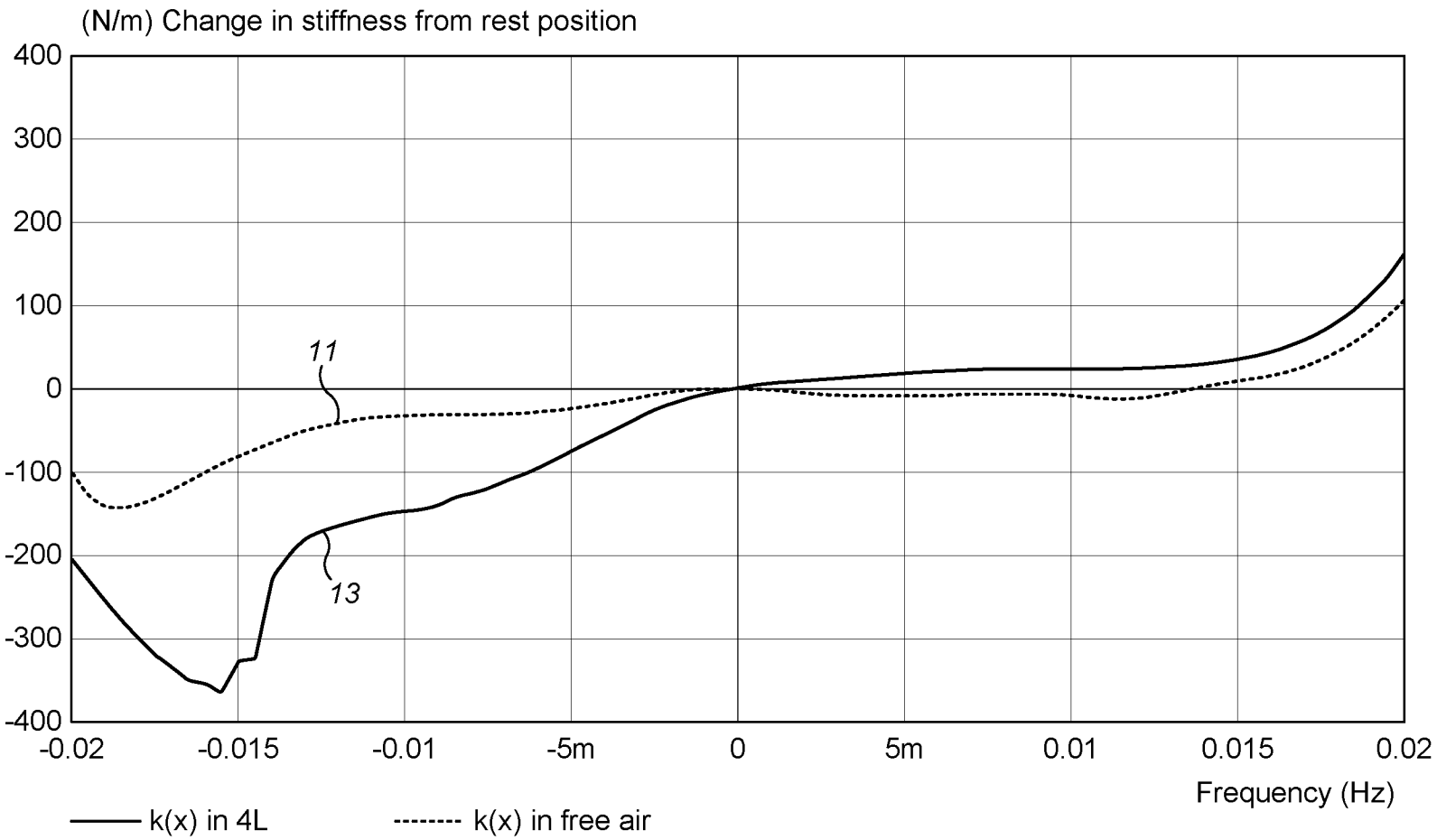
FIG. 3 illustrates the change in restoring force for two similar prior art surrounds.
Figure 4:
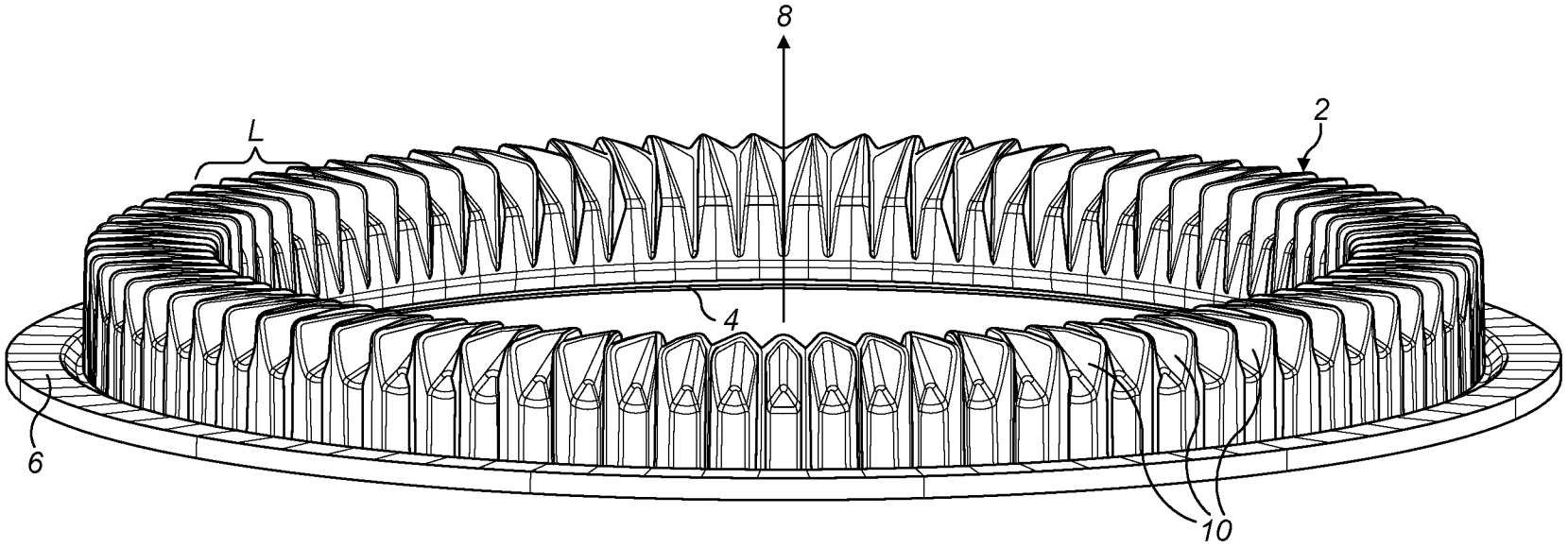
FIG. 4 is a schematic perspective view of an annular loudspeaker driver surround, or suspension, in accordance with the invention.

FIG. 4 shows an annular loudspeaker suspension 2 in its relaxed state (as is the case in all of the subsequent drawings) which has a flat outer circumferential edge 6 for mounting or clamping to the loudspeaker enclosure (not shown) and a flat inner circumferential edge 4 which is configured to be attached to the diaphragm (not shown) or to the voice coil (not shown) of the loudspeaker. The inner and outer edges 4, 6 are in approximately the same plane. In use, the voice coil and the diaphragm vibrate at audio frequencies in the direction of the central axis 8 of the annular surround 2, and the outer edge 6 remains fixed whilst the inner edge 4 reciprocates along axis 8 relative to the outer edge 6 and the loudspeaker enclosure. The suspension 2 is unitary (i.e. formed in one piece) and is formed of a suitably resilient material (such as by being moulded of an elastic material, as is known in the art), and serves to hold the diaphragm/voice coil aligned on the axis 8 throughout the reciprocal motion, and also to urge the diaphragm/voice coil towards a central position where the surround is in its relaxed state, e.g. so that the two edges sit in approximately the same plane along axis 8, counteracting the drive forces produced by the voice coil. Thus far, the surround described has all the attributes of known loudspeaker surrounds, and is as described above in relation to the prior art.

The surround 2 is very generally in the form of a part of a torus, in that it protrudes in the direction of axis 8 away from the general plane of the inner and outer edges 4, 6; however, the protruding portion of the surround (the 'roll surface') is formed with a plurality of corrugations 10 which give it a complex, non-axisymmetric shape, particularly when viewed along the direction of the axis 8. The roll surface has inner and outer sidewalls 18, 20 (shown in FIG. 5A) which extend generally axially and which are generally cylindrical, and these are connected to the inner and outer edges at a crease 16. The corrugations 10 extend along a part of the sidewalls 18 and blend smoothly into the sidewalls at or before reaching the crease 16.

Figure 5A:
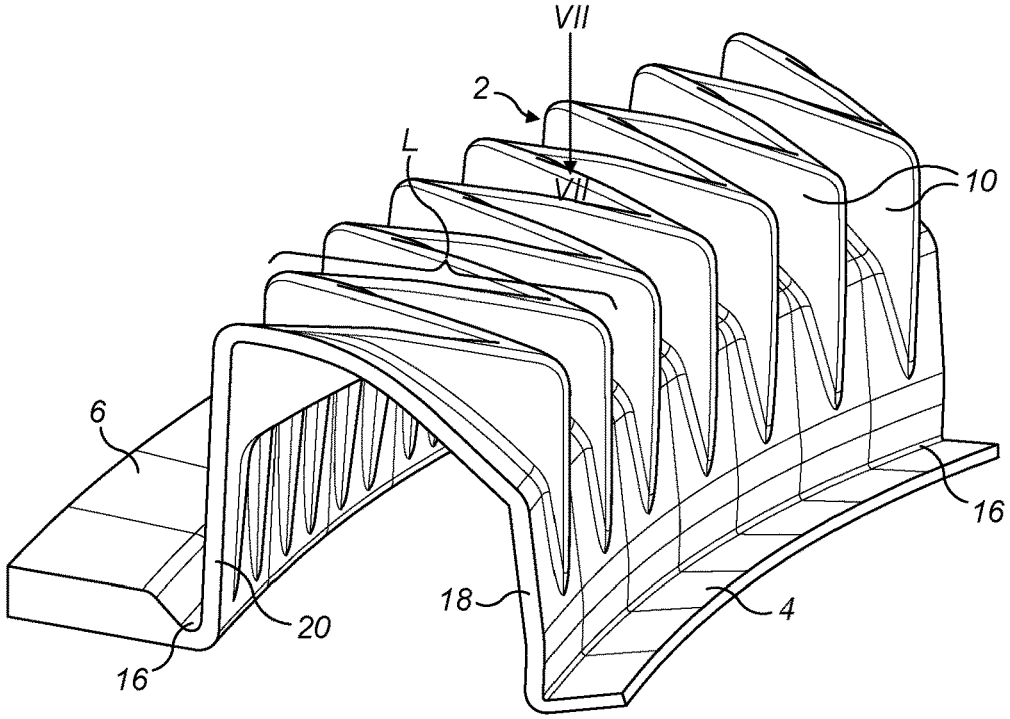
FIG. 5A is an enlarged, part-sectional view of a part of the surround of FIG. 1.
Figure 5B:
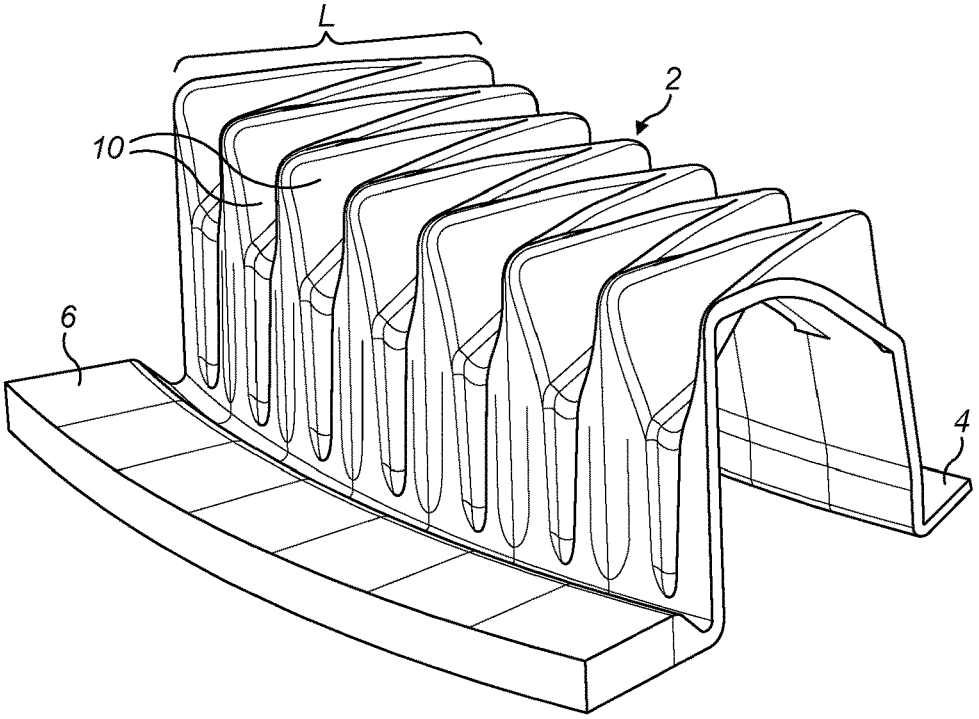
FIG. 5B is an enlarged, part-sectional view from another direction of the part of FIG. 5A.

The important features of the shape of the corrugated surface of the surround 2 between the outer and inner edges 4, 6 are, firstly, that it is not axisymmetric about axis 8 (meaning that if successive radial cross-sections are taken at different positions around axis 8, the shape of those cross-sections does not remain constant (it will be noted from FIGS. 5A and 5B that the corrugations 10 blend smoothly into outer and inner sidewalls 18, 20 which are either cylindrical or frusto conical and extend along the axis 8; sidewalls are not an essential feature of the invention, but where they are present the corrugations 10 must continue onto the sidewall to prevent it from buckling, and could blend smoothly into the crease 16 where the surround turns to form the flat inner and outer edges, as shown in FIG. 5A). Secondly, the corrugations 10 are shaped repetitively and substantially similarly; this gives the projecting roll surface an order of rotational symmetry of at least 30 and, subject to manufacturing constraints, up to 100 or even 200 or any number between these extremes; such a high number of corrugations makes the surround effective in resisting back pressure within the loudspeaker enclosure, whilst they each form the leaves of a 'hinge' that opens or unfolds to allow the driver to move while resisting the pressure from the change in volume of the enclosure. The arrangement is such that there is no part of the roll surface which does not have corrugations. Thirdly, the corrugations are shaped such that, if radial cross-sections of the roll surface are taken at different angular positions around the axis 8, the length of the roll surface in a radial direction between the edges 4, 6 remains constant. Fourthly, the corrugations are at alternate and substantially equal angles to the radial direction in a zigzag pattern, as is best seen in FIG. 7. Fifth, the radial profile of the roll surface varies between a half roll shape and a sharp cornered saw tooth shape (with alternate steep and gentle slopes, as seen in FIGS. 5A-B, 6A-6B and 10B) so as to give a large change in axial position for points on the roll surface at successive circumferential positions. Finally, if the points along the saw tooth pattern which are furthest from the edges 4, 6 in the axial direction 8 were used to generate a leading surface L of the roll surface, this leading surface L is generally annular about the axis 8, but is not planar (although in the drawings it might appear so, it can be seen in FIGS. 6A and 6B that the leading surface L' is not planar, but instead is very slightly convex—this is described further below, with reference to FIGS. 10A-10B).

The overall shape of the roll surface permits the roll surface to "unfold" without buckling as the surround vibrates in use, to the extent that, were the inner edge 6 to be displaced along the axis 8 relative to the outer edge 4 to the maximum extent possible, the roll surface would unroll completely to form a substantially smooth, frusto-conical shape, but without any buckling and without any rotation of the inner edge 6 relative to the outer edge 4; this minimises the mass of the surround for the maximum excursion of the central diaphragm, and allows the restoring force of the surround (the resilience of the material from which it is formed which moves the surround from a driven opposition towards the relaxed position) to be substantially linearised.

FIGS. 5A and 5B are enlarged views of part of the surround 2 shown in FIG. 4, and FIG. 7 is a plan view of that surround, as seen along the axis 8. It can be seen in FIG. 7 that the rounded corrugations axially furthest from the edges 2,4 form a symmetrical zigzag shape which has portions 12, 14 (also shown in FIG. 7) which alternate at similar but opposite angles to the radial direction, and which terminate at rounded "knees", or "shoulders", 36, 38 (see FIG. 10B) pointing alternately inwards and outwards; these corrugations allow the surround to deform without any rotational movement of the inner edge 6 relative to the outer edge 4. When viewed along the axis, the shoulders 36, 38 lie along two circumferential rings, one towards the inner edge of the annular surround and the other towards its outer edge. The angle of the corrugations to the radial direction is dependent on the size and number of corrugations; in a surround having 50 corrugations, each corrugation subtends about 7.2° and successive portions 12, 14 are angled at about 15° to the radial direction.

Figure 6A:
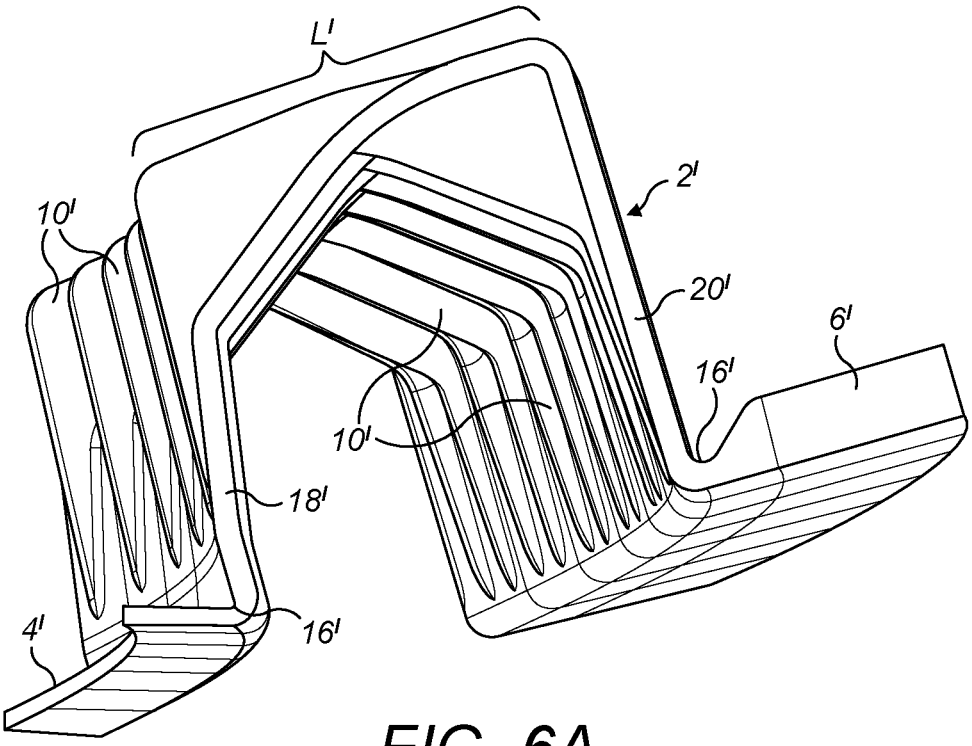
FIG. 6A is a schematic part-sectional view of a section of another loudspeaker driver surround, or suspension, in accordance with the invention.
Figure 6B:
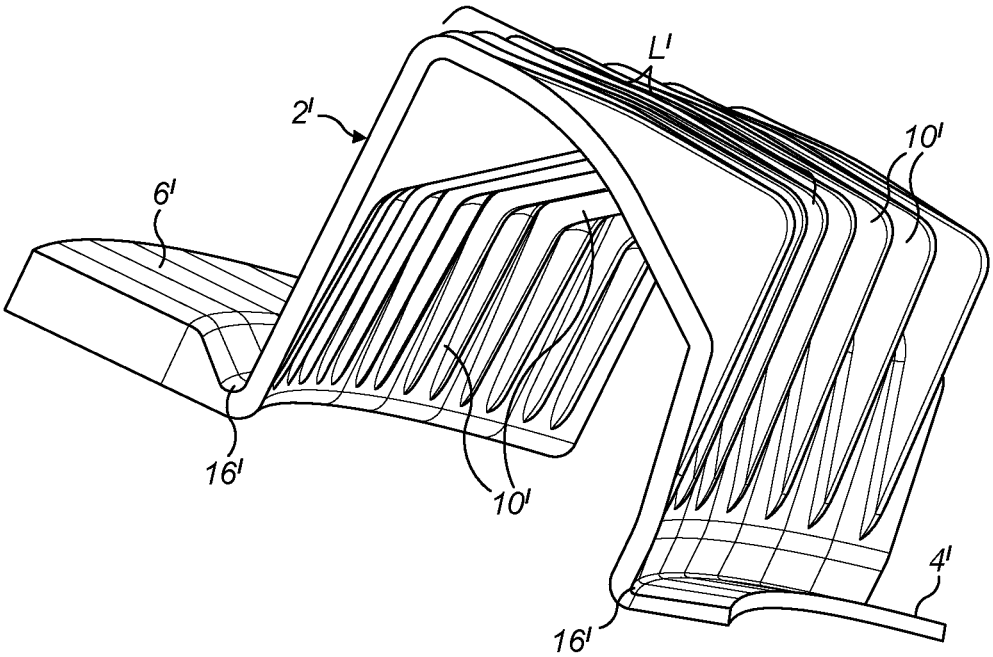
FIG. 6B is an enlarged, part-sectional view from another direction of the part of FIG. 6A.
Figure 7:
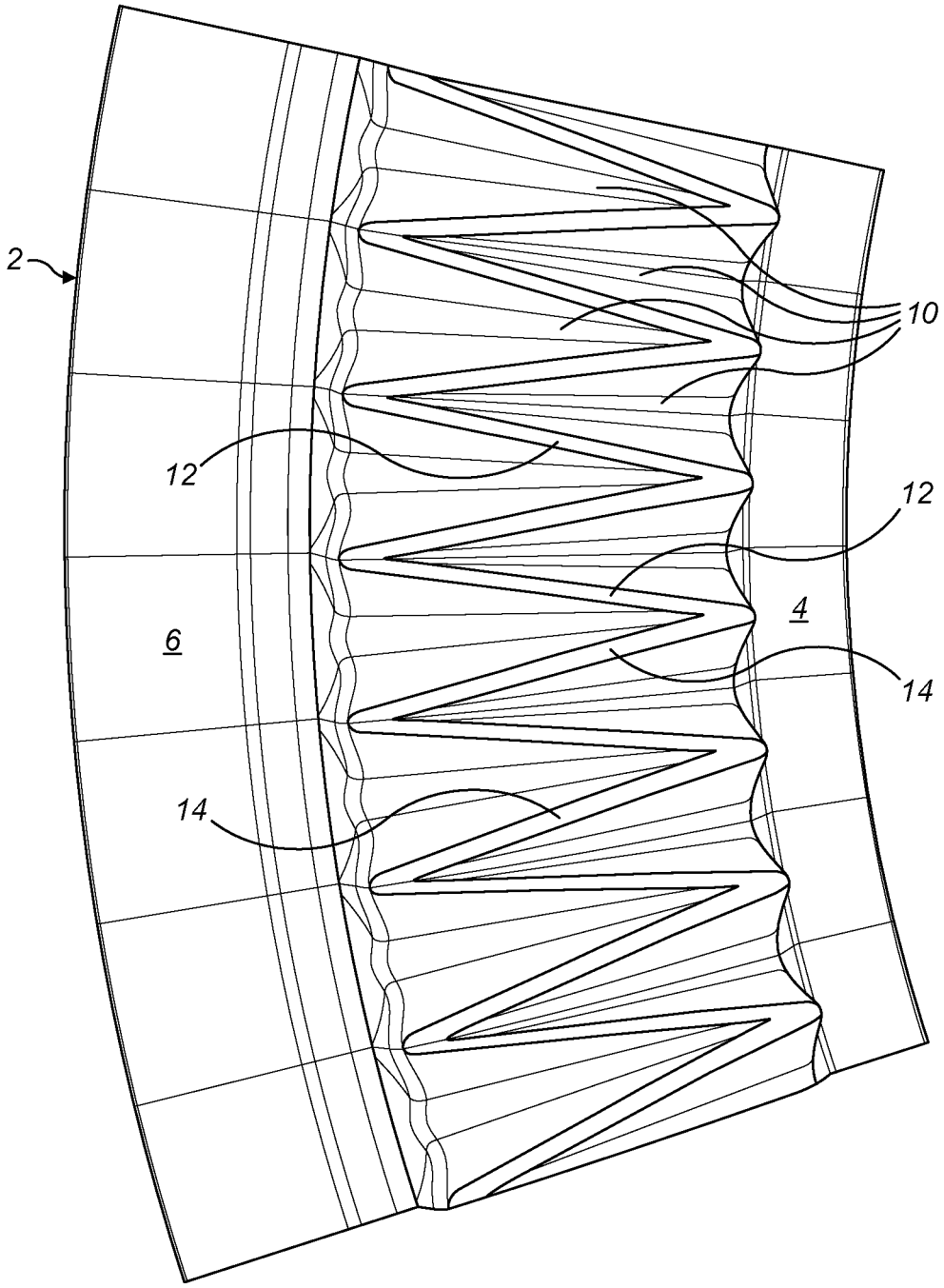
FIG. 7 is an axial view of the part shown in FIG. 5A, in the direction of the arrow VII-VII.

FIGS. 6A and 6B show two sections of an alternative form of surround 2' in which features similar in function but not necessarily shape or configuration to those in the surround 2 of FIG. 4 are given the same reference numeral as in FIG. 4 but with the addition of a dash. In these drawings the corrugations 10 clearly extend along the inner and outer axial sidewalls 18', 20' of the roll surface towards the crease 16'. The corrugations 10, 10' are preferably smooth, as this facilitates manufacture of the surround (smoothly curved shapes are easily moulded, where sharp corners would make the mould more expensive, and/or make it more complicated and the surround liable to 'stick' in the mould). The inner circumferential edge 4' is shown at a slight angle to the plane of outer edge 6' (in the direction of the leading surface) so as to be suitable to have a conical or domed diaphragm attached thereto.

Figure 8A:
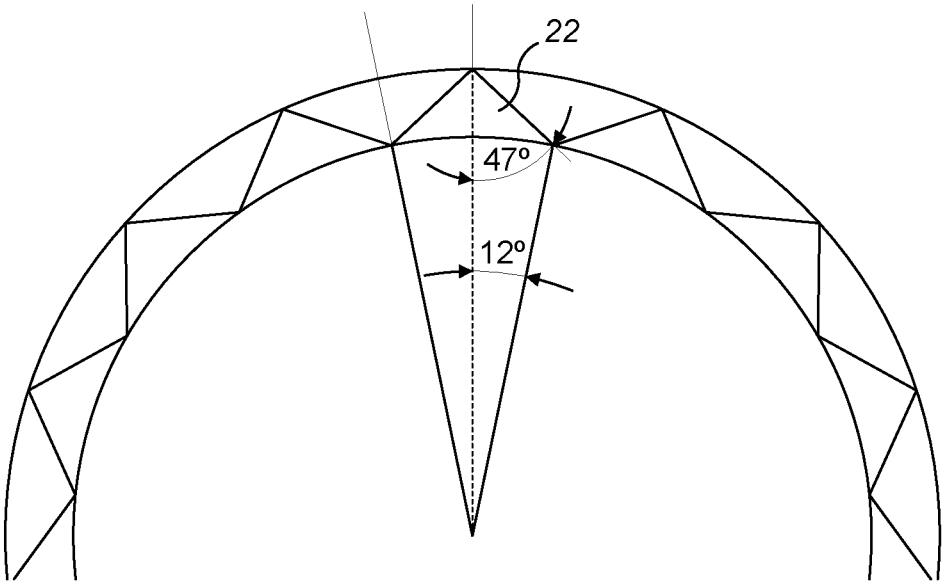
FIGS. 8A and 8B illustrate the principle behind the number of repetitions of the pattern of the corrugations in the roll surface in surrounds in accordance with the invention.
Figure 8B:
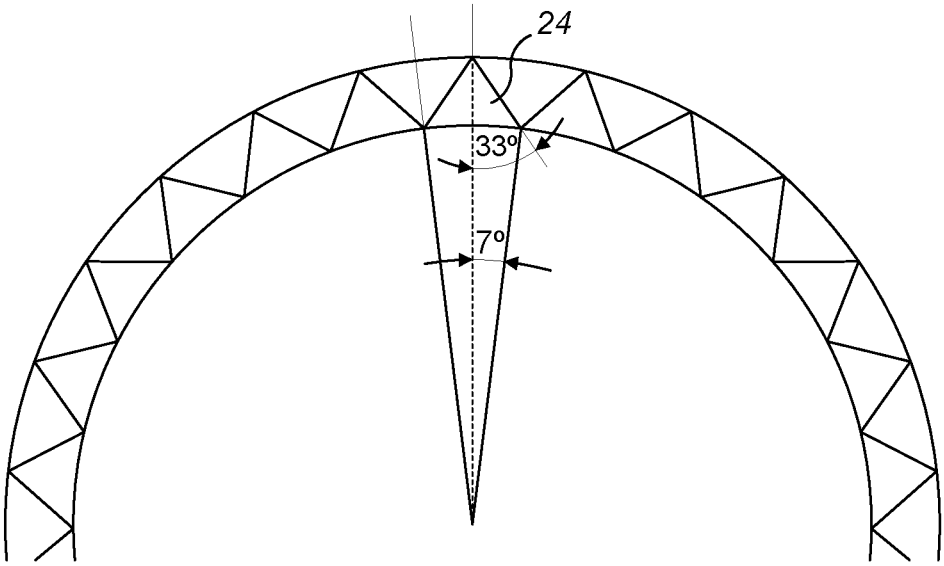

FIGS. 8A and 8B illustrate the principles for determining the number of corrugations which should be used. When a simple cylindrical half round surround crumples and geometric buckling occurs, when the buckled surround is viewed axially it looks like a many pointed star. The number of points of the star is mainly determined by the ratio of the inside clamp diameter at the cone and the outside clamp diameter at the surround foot. From measurements of surrounds of various sizes in free air, it has been found that the angle the folds make with a radius (fold angle) is between 30° and 50° (rounded for an integer number of repetitions per 360°). Adding corrugations gives the surround points at which to "fold" into a smaller diameter, thus eliminating the abrupt geometric buckling. The number of corrugations must be at least the number of geometric buckling points with a 50° fold angle, and preferably several times more. FIGS. 8A and 8B show how the number of geometric buckling points is determined on a simple half roll surround with a 1:1.175 ratio of inside: outside diameter. FIG. 8A relates to the maximum fold angle and gives the minimum number of geometric buckling points; 15 folds spaced 24° apart, give a fold angle 22 of 47° (predicted minimum number of geometric buckling points), therefore a minimum of 15 corrugations would be required to eliminate geometric buckling. In the example of FIG. 8B, which relates to the minimum fold angle, 26 folds spaced 13.85° apart, give a fold angle of 33° (predicted maximum number of geometric buckling points). Therefore a minimum of 15, and preferably more than 30 corrugations would be required to eliminate geometric buckling in this surround. For resisting pressure deformation, the number of repetitions may need to be higher, as the aim is not only to allow the surround to fold without buckling, but also for it to have the strength to resist the pressure deformation. More corrugations make the surround stronger, and so effectively thicker for the same surround thickness. The exact number of corrugations required to resist the pressure deformation should be greater than the maximum predicted number of geometric buckling points for the surround; this number depends on the surround width, material thickness, and change in cabinet volume, but is typically of the order of 30 or higher. For a large surround the inner:outer diameter is typically around 1:1.3, which would give a minimum of 17 folds, and for very large surrounds, of inner:outer diameter as large as 1:1.45, there would be a minimum of 13 folds, and for such surrounds about 30 corrugations would be suitable.

Figure 9:
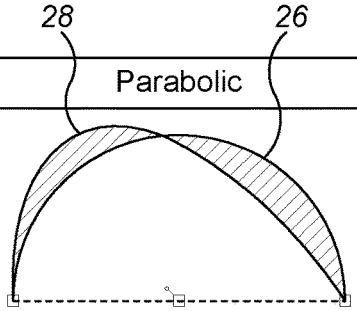
FIG. 9 illustrates the principle behind the radial cross-sectional shape of the corrugations in the roll surface in surrounds in accordance with the invention.
Figure 9:
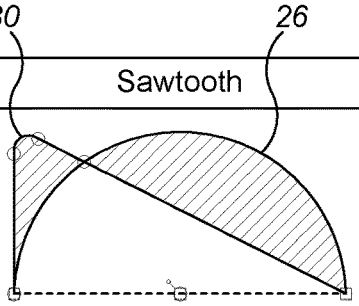

FIG. 9 illustrates how the radial cross-sectional shape of the roll surface should be chosen. In order to make the surround effectively thick, the change in shape of the surround profile should be large. Varying between a half roll profile and saw teeth profiles of alternating directions gives a large change in position for each point along the surround length, and so increases the effective thickness. The effective thickness is defined as the area of the difference between the middle and extreme profiles divided by the length of the roll. FIG. 9 shows a comparison of the shape, viewed in radial cross-section, where the alternating saw tooth pattern varies between a half roll shape 26 and an alternating parabolic shape 28, and between a half roll shape 26 and a sharp saw tooth shape 30. Both the alternating parabolic shape 28 and the sharp saw tooth shape 30 are of equal length to the half roll 26, which is 20 mm in diameter. The effective thickness is the total area formed by the difference between the extreme surround profiles divided by the length. As can be seen, the effective thickness of the sharp saw tooth 30 is more than twice the parabolic shape 28, so it will be better at resisting pressure deformation.

The effective thickness ratio is the effective thickness divided by the material thickness of the surround. For a surround 0.7 mm thick, this would give an effective thickness ratio of 1.709 for the parabolic profile, and 3.809 for the saw tooth profile.

Figure 10A:
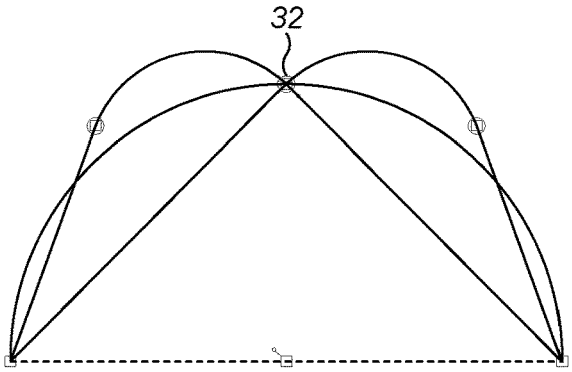
FIGS. 10A and 10B are schematic radial cross-section views showing the principle of the shape of the corrugations in the roll surface in surrounds in accordance with the invention.
Figure 10B:
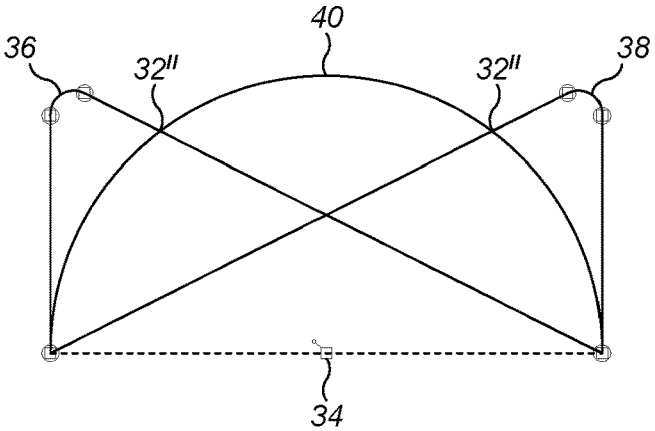

It is important to ensure that there is no rotational symmetry at any point on the surround other than the edges. FIGS. 10A-10B show two surrounds of the same length with different corrugation profiles. For the surround in FIG. 10A, the centre point 32 is common to all three profiles (the left hand extreme, the half roll and the right hand extreme) so forms a thin circular ring of material that is prone to geometric buckling. The surround in FIG. 10B has no common points between all three profiles, only two spaced points 32" where there are common points between two profiles, so this surround is much less liable to buckle geometrically but instead it unfolds at the corrugations, and also has a greater effective thickness. Although the left and right hand peaks, or "shoulders" 36, 38 are at the same height above the line 34 (i.e. at the same axial distance from the inner and outer circumferential edges of the surround), they are not at the same height as the half roll peak 40, so that the line of points along the roll surface joining peaks 36, 38, 40 which are axially most distant from the circumferential edges varies in axial position at the same time as it varies in radial and circumferential position: this produces a leading surface (as defined above) which is generally annular about axis 8, but non-planar. The effective thickness and the rotational symmetry can be optimised empirically, subject to the ability of the manufacturing process to accommodate the resulting roll surface shape.

It will of course be understood that many variations may be made to the above-described embodiment without departing from the scope of the present invention. For example, the invention has been described with reference to a circular driver surround, but it should be understood that the invention applies equally to non-circular diaphragms, such as elliptical or race track shaped diaphragms, or any shape being symmetrical in two orthogonal directions lying in the general plane of the diaphragm and having a central hole (such as a square or rectangle, with rounded corners). Accordingly, unless clearly indicated otherwise, any use in this description or in the claims of the terms "annular", "circumference", "circumferential", "circumferentially" or "around" should not be construed as being restricted to a circular shape, nor as necessarily being centred on a single axis but instead construed broadly as any substantially two-dimensional shape bounded by a closed loop. The invention has been described above in terms of the outer edge of the annular suspension being fixed and the inner edge moving relative thereto, as this is the arrangement in the majority of loudspeakers; however, it will be appreciated that the reverse arrangement (inner edge fixed, outer edge moving) could work equally as well, and so falls within the ambit of this invention. The roll surface can be directed in either axial direction from the outer edges (i.e. a roll or a reverse roll). The corrugations have been described as having a zigzag pattern, of equal and opposite angles which alternate in direction; the zigzag pattern could alternatively be sinusoidal, or in any other repeating waveform. Where different variations or alternative arrangements are described above, it should be understood that embodiments of the invention may incorporate such variations and/or alternatives in any suitable combination.

The invention claimed is:

1. A loudspeaker driver surround comprising a generally annular element of resilient material and having a central axis along which in use a diaphragm is driven, a first circumferential edge for fitment to an enclosure and a second circumferential edge for fitment to the diaphragm and/or a voice coil, with a roll surface extending between the edges which projects in the direction of the axis, wherein the roll surface has a shape formed by a plurality of axial corrugations extending generally radially with respect to the annular element between the first and second edges thereof, the corrugations being shaped and configured such that the roll surface is non-axisymmetric about the axis, and the arrangement being such that cross-sections of the roll surface which extend radially with respect to the annular element between the first and second edges thereof have a substantially constant length at all circumferential positions around the annular element and so that the shape of the said cross-section varies continuously between circumferential positions around the annular element, the corrugations giving the projecting roll surface an order of rotational symmetry of at least 30.

2. The loudspeaker driver surround as claimed in claim 1 wherein (when the annular element is viewed axially) points on some of the corrugations, which points are most axially distant from the circumferential edges, form generally linear creases at a first angle to the radial direction between outer and inner edges.

3. The loudspeaker driver surround as claimed in claim 2 wherein (when the annular element is viewed axially) points on others of the corrugations, which points are most axially distant from the circumferential edges, form generally linear creases at a second angle to the radial direction between the outer and inner edges.

4. The loudspeaker driver surround as claimed in claim 3, wherein the first and second angles are equal and opposite.

5. The loudspeaker driver surround as claimed in claim 3, wherein in radial cross section the roll surface comprises a succession of curves alternating to the left and right hand side of a centre line, said curves blending into a uniform roll surface between each curve.

6. The loudspeaker driver surround as claimed in claim 5 wherein the curves on the left and right hand side are similar but reversed.

7. The loudspeaker river surround as claimed in claim 5, wherein the uniform roll surface is a half roll surface.

8. The loudspeaker driver surround as claimed in claim 3, wherein if the parts of the corrugations which are most axially distant from the circumferential edges are used to generate a leading surface, that leading surface would not be planar.

9. The loudspeaker driver surround as claimed in claim 1, wherein the shape and configuration of the corrugations on the roll surface are such that, if the first edge of the annular element were extended axially away from the second edge to the maximum extent possible, the roll surface and the corrugations thereof would unfold to adopt a substantially smooth frusto-conical shape.

10. The loudspeaker driver surround as claimed in claim 1, wherein the roll surface has a sidewall adjacent the first edge which extends substantially axially.

11. The loudspeaker driver surround as claimed in claim 1, wherein the roll surface has a sidewall adjacent the second edge which extends substantially axially.

12. The loudspeaker driver surround as claimed in claim 1, wherein successive corrugations blend smoothly into each other.

13. The loudspeaker driver surround as claimed in claim 1, wherein the corrugations blend smoothly into the first and/or second edges.

14. The loudspeaker driver surround as claimed in claim 1, wherein the thickness of the roll surface is substantially constant.

15. The loudspeaker driver surround as claimed in claim 1, wherein the first circumferential edge is the inner edge of the generally annular surround and the second edge is the outer edge of the surround.

16. A loudspeaker comprising a driver surround, the driver surround comprising a generally annular element of resilient material and having a central axis along which in use a diaphragm is driven, a first circumferential edge for fitment to an enclosure and a second circumferential edge for fitment to the diaphragm and/or a voice coil, with a roll surface extending between the edges which projects in the direction of the axis, wherein the roll surface has a shape formed by a plurality of axial corrugations extending generally radially with respect to the annular element between the first and second edges thereof, the corrugations being shaped and configured such that the roll surface is non-axisymmetric about the axis, and the arrangement being such that cross-sections of the roll surface which extend radially with respect to the annular element between the first and second edges thereof have a substantially constant length at all circumferential positions around the annular element and so that the shape of the said cross-section varies continuously between circumferential positions around the annular element, the corrugations giving the projecting roll surface an order of rotational symmetry of at least 30.

* * * * *